US006466755B2

(12) United States Patent
Yano et al.

(10) Patent No.: US 6,466,755 B2
(45) Date of Patent: Oct. 15, 2002

(54) IMAGE FORMING APPARATUS WHICH A DEVELOPING ROLL IS CAPABLE OF CONTACTING WITH AND SPACING FROM

(75) Inventors: Hideyuki Yano, Mishima; Michio Uchida, Susono, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/774,585

(22) Filed: Feb. 1, 2001

(65) Prior Publication Data

US 2001/0012461 A1 Aug. 9, 2001

(30) Foreign Application Priority Data

Feb. 4, 2000 (JP) ..... 2000-032788

(51) Int. Cl.[7] ..... G03G 15/08; G03G 15/01
(52) U.S. Cl. ..... 399/234; 399/265
(58) Field of Search ..... 399/222, 223, 399/228, 230, 234, 265

(56) References Cited

U.S. PATENT DOCUMENTS 4,814,816 A * 3/1989 Idenawa ..... 399/234
5,404,213 A * 4/1995 Okano et al. ..... 399/127
5,598,255 A * 1/1997 De Cock et al. ..... 399/234

FOREIGN PATENT DOCUMENTS

JP 6-258924 * 9/1994
JP 9-6151 * 1/1997

* cited by examiner

*Primary Examiner*—Joan Pendegrass
(74) *Attorney, Agent, or Firm*—Fitzpatrick, Cella, Harper & Scinto

(57) ABSTRACT

An image forming apparatus has an image bearing member, a charger for charging the image bearing member image forming means for selectively erasing charge on the image bearing member to thereby form an electrostatic image, and a developing device for developing the electrostatic image. The developing device includes a developing roll contacting with the image bearing member and is capable of having a developing bias applied thereto and contacting and spacing device for contacting and spacing the developing roll with respect to the image bearing member. The contacting and spacing device contacts the developing roll having the developing bias applied to the area thereof charged by the charger with the image bearing member at a start of image formation.

8 Claims, 3 Drawing Sheets

IMAGE FORMING APPARATUS WHICH A DEVELOPING ROLL IS CAPABLE OF CONTACTING WITH AND SPACING FROM

BACKGROUND OF THE INVENTION

1. Field of the Invention

This invention relates to a developing apparatus used in an image forming apparatus such as a copier or a printer using the electrophotographic method or the electrostatic recording method to develop an electrostatic image on an image bearing member.

2. Related Background Art

In recent years, higher speeds, higher functions and coloring have been advanced in image forming apparatuses such as electrophotographic apparatuses, and printers of various types have become available in the market.

From the viewpoint of the higher speed of printers, the studies and development of in-line type apparatuses in which a plurality of electrophotographic units for forming different color images are disposed in series and these are driven at a time to thereby effect image formation have been advanced, and these apparatuses have wide possibilities in business use because they can form color images at a high speed.

Particularly, because of the small number of process constituents and accordingly the ease of downsizing and cost reduction, there have been developed numerous in-line printers of the transferring belt type in which paper is adsorbed to a transferring belt serving also as a conveying belt and the superimposition transfer of toner images is effected from a plurality of image forming units.

Further, in recent years, there has been developed a longitudinal pass printer of the in-line type in which process forming units are disposed longitudinally with a view to reduce the installation area thereof. In this type, it is necessary to convey paper upwardly against gravity and therefore, bad adsorption leads to the jam of the paper and thus, importance is particularly attached to the adsorbing performance.

Generally, as shown in FIG. 2 of the accompanying drawings, paper passes between adsorbing rollers which are disposed in opposed relationship with the upstream entrance of a transferring belt and to which a voltage has been applied, whereby charges are imparted to the paper, which is thus electrostatically attracted to and conveyed by the transferring belt.

The adsorbing roller is normally urged against the transferring belt generally in the most upstream portion of the whole station, and assumes a construction in which it is driven to rotate relative to the transferring belt.

Regarding the printer of the in-line type, the problem that it is inferior in usability because of the fact that in the construction thereof, the main body thereof is liable to become bulky and has many interchangeable parts has been pointed out.

Particularly regarding the interchangeable parts, it is necessary to frequently interchange cartridges for four colors and a waste toner container for the transferring belt and in addition, considering the life of the main body including a fixing device, a sheet feeding roller, etc., the user must interchange many parts, and this becomes a factor which increases the user's running cost and further, the labor required for the interchange and the obtainment of the parts become the user's load and therefore, it is required to decrease the interchangeable parts as much as possible.

The waste toner container for the transferring belt which is one of the interchangeable parts is for collecting therein toners appeared when cleaning is effected so that toners left on the transferring belt by the image formation on the transferring belt for the detection of jam and density and the detection of registration may not adversely affect the next image printing.

Generally the cleaning of the transferring belt is to scrape off the toners by a cleaning blade or a rotary fur brush brought into pressure contact with the surface of the transferring belt and collect them in the waste toner container.

This waste toner container is not essentially necessary for printing, but is provided inevitably and the interchange thereof is virtually meritless to the user and therefore has remarkably spoiled usability.

Also, the provision of the interchangeable waste toner container has led to the problem of the bulkiness and complication of the construction of the main body.

As a different way of thinking, there is the concept of making the waste toner container large in size and install it on a transferring belt unit or the main body in order to improve the convenience in usability, but when the waste toner container is filled up due to some cause or the other, it is necessary to bodily interchange the unit, and this has likewise become a factor for the bulkiness or risk of the main body.

As a method of solving these problems, there has been proposed the technique of not providing a cleaner for the transferring belt, but electrostatically collecting the toners on a photosensitive body. Particularly in the printer of the in-line type, there are four process cartridges and therefore, there are four chances for collecting the toners on the belt per one round of the transferring belt, and this is advantageous.

Further, during the cleaning sequence for the transferring belt, the polarities of voltages applied to the transferring member at four stations are made different and an electric field in the opposite direction is formed at each station to thereby collect toners of the positive and negative polarities.

Furthermore, it is also possible to adopt such a construction in which the voltage applied is made great to thereby charge the toners on the transferring belt in the transferring portion and collect the toners at the next station.

When these techniques are used, it is necessary to provide a transferring belt cleaning sequence for changing over the voltage of the transferring portion, or incorporate a cleaning sequence in the post-rotation subsequent to image formation, discretely from the ordinary image forming sequence.

On the other hand, in the image forming apparatus of the in-line type, respective color images are formed by image forming units and therefore, such image forming apparatus essentially suffers from the disadvantage that the color balance is liable to be destroyed or it is difficult for the registration of each color.

Heretofore, regarding the color balance in each unit, use has been made of means for forming a density patch image of each color in an intermediate transferring member (hereinafter referred to as the ITB) or an electrostatic transferring belt, reading it by a density detecting sensor, and feeding it back to a process forming condition such as a high voltage condition or laser power to thereby adjust the maximum density of each color and a halftone gradation characteristic.

Also, likewise in color registration, use is made of means for forming a patch for registration detection on a transferring belt, reading it by an optical sensor, and feeding it back to an image writing position or the like to thereby effect correction.

Generally, the density detecting sensor irradiates the density patch with a light source, detects the intensity of reflected light by a light receiving sensor, handles the image density as the intensity information of the light, and electrically processes it.

Image density control has as its objects to keep the maximum density (hereinafter referred to as the Dmax) of each color constant, and to keep the halftone gradation characteristic linear relative to an image signal.

The control of the Dmax is very meaningful in keeping the color balance of each color constant and at the same time, preventing the scattering or bad fixing of color-superimposed characters by the excessive deposition of toners.

On the other hand, halftone gradation control is usually to effect such image processing that in order to prevent output density from deviating relative to input and output image signals by a non-linear input-output characteristic ($\gamma$ characteristic) peculiar to electrophotography to thereby fail to form a natural image, the $\gamma$ characteristic is negated and the input-output characteristic is kept linear.

On the other hand, a registration sensor reads a registration patch formed by a line image by a focused light receiving sensor, and electrically processes a variation with time in the intensity of the signal of the light receiving sensor when the registration patch passes it as positional deviation information.

When effecting such optical detection, it is effective to once measure the reflectance of the transferring belt forming the toner thereon as the ground before reading the optical information of the toner image, and compare this measured value with the measured value after the formation of the toner to thereby improve detection accuracy.

Specifically, by normalizing the sensor output after the toner image has been formed, with the sensor output corresponding to the reflectance when the ground of the transferring belt has been measured as 1, it becomes possible to always measure the density of a stable toner image irrespective of the toner stain of the surface of the transferring belt, the roughness of the surface of the transferring belt by the endurance thereof, etc.

However, when an apparatus of a type having no cleaning station for the transferring belt is constructed with an aim at improved usability, the unintended toner development from a developing device and fog cause problems.

In a case where the contact developing system is u s ed as the developing system, when the developing device is started (rotated) with a developer carrying member and an image bearing member being in contact with each other, the toner in the first contact nip portion is used for development to thereby create a lateral line-line fog image.

This phenomenon is seen more remarkably when the apparatus is stopped for a long period and the triboelectricity of the developer is reduced, and there arises the problem that this toner used for development shifts to the transferring belt to thereby stain the back of the paper during printing.

Also, when during the prerotation before printing, the developing device is rotating while being in contact with the image bearing member, fog toner used for development adheres, though slightly, to the transferring belt. If a cleaning apparatus is provided for the transferring belt, belt cleaning is done once per one round of the transferring belt and therefore, no toner accumulates on the transferring belt, but in a cleaningless system, the transferring belt has sometimes been stained by fog toner due to long-time idle rotation such as prerotation to thereby cause the stain of the back of the next image.

Also, the presence of such toner stain and fog on the transferring belt might adversely affect the ground measurement when the optical detection of the toner density or the like such as density detection or registration detection is effected, thereby causing a detection error.

SUMMARY OF THE INVENTION

It is an object of the present invention to provide an image forming apparatus which can prevent the fog in the contact development at the start of image formation.

It is another object of the present invention to provide an image forming apparatus which can reduce the toner stain of a transferring belt.

It is still another object of the present invention to provide an image forming apparatus comprising:

an image bearing member;

a charger for charging the image bearing member; image forming means for selectively erasing a charge on the image bearing member to thereby form an electrostatic image;

a developing device for developing the electrostatic image, the developing device having a developing roll contacting with the image bearing member and having a developing bias applied thereto; and contacting and spacing means for contacting and spacing the developing roll with respect to the image bearing member;

the contacting and spacing means contacting the developing roll having the developing bias applied to the area thereof charged by the charger with the image bearing member at a start of image formation.

Other objects of the present invention will become apparent from the following description.

DESCRIPTION OF THE PREFERRED EMBODIMENTS

The preferred embodiments of the present invention will hereinafter be described in detail by way of example with reference to the drawings. However, the dimensions, materials and shapes of constituent parts and the relative disposition thereof described in these embodiments should be suitably changed depending on the construction and various conditions of an apparatus to which the present invention is applied, and the scope of the present invention is not restricted to the following embodiments.

[Embodiment 1]

Figure 2:
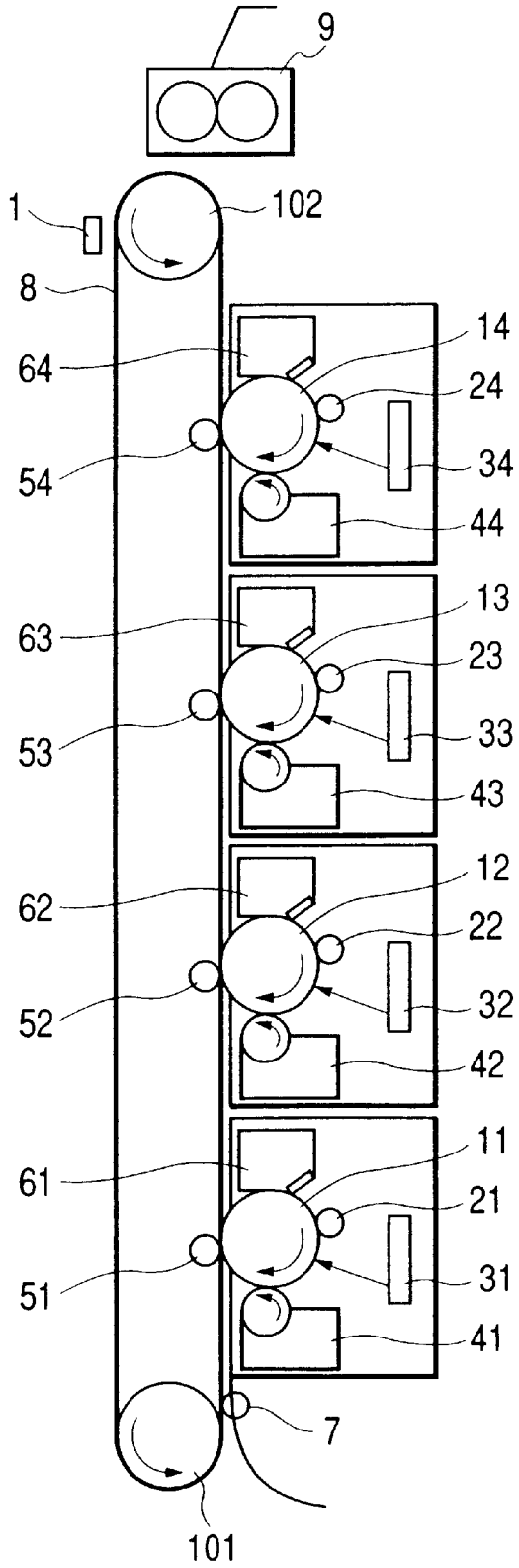
FIG. 2 is a schematic construction view showing the relation between developing devices and photosensitive bodies according to Embodiment 1 of the present invention.

FIG. 2 is a schematic cross-sectional view of a color image forming apparatus (a copier or a laser printer) utilizing the electrophotographic process. This apparatus is of a construction in which four independent color stations having Y, M, C and K photosensitive drums (image bearing members), developing devices (developing means) and cleaning means are arranged in tandem, and paper (recording material) adsorbed to an electrostatic transferring belt (transferring member) is conveyed to these and transfer is effected to thereby obtain a full color image.

The reference numerals 11 to 14 designate rotatable drum type electrophotographic photosensitive bodies (hereinafter referred to as the photosensitive drums) repetitively used as image bearing members, and rotatively driven at a predetermined peripheral speed (process speed) in the clockwise direction of arrow.

The photosensitive drums 11 to 14 are negatively charged OPC photosensitive bodies having a diameter of 30 mm, and the process speed of the image forming apparatus according to the present embodiment is 100 mm/s.

The photosensitive drums 11 to 14 are uniformly charged to a predetermined polarity and potential during the process of rotation by primary charging rollers 21 to 24 as charging means, and then are subjected to image exposure by (image) exposing means 31 to 34 (comprised of laser diodes, polygon scanners, lens units, or the like), whereby electrostatic latent images corresponding to the first to fourth color component images (e.g. yellow, magenta, cyan and black component images) of a desired color image are formed on the photosensitive drums.

The charging means are of a DC contact charging type in which a roller of real resistance $1\times10^6$ Ω having a DC voltage of −1.2 kV applied thereto is brought into contact with the photosensitive drum with total pressure 9.8 N to thereby effect charging, and the surfaces of the photosensitive drums are charged to −600 V.

Also, the image exposing means used in the present embodiment are polygon scanners using laser diodes, and image laser beams modulated by image signals on the drums to thereby form electrostatic latent images.

The writing of laser exposure is effected with a delay of a predetermined time from a position signal in the polygon scanner called BD for each scanning line in the main scanning direction (a direction orthogonal to the direction of movement of the paper), and from TOP signal having a switch in a paper conveying path as the starting point in the subscanning direction (the direction of movement of the paper), whereby in each color station, exposure can be effected always at the same position on the same paper.

The electrostatic latent images are then developed by developing units in the respective stations. Developing devices 41 to 44 (yellow, magenta, cyan and black) as developing means are rotated in the direction of arrow by a rotatively driving device, not shown, and the respective developing devices 41 to 44 are disposed so as to be opposed to the photosensitive drums 11 to 14 in the developing process.

Y, M, C and BK toners are so-called nonmagnetic toners containing no magnetic material, and the latent images are developed by the nonmagnetic monocomponent contact developing method.

The developing devices 41 to 44 use the nonmagnetic monocomponent developing method, and are rotated at a peripheral speed of 170% in a forward direction relative to the photosensitive drums 11 to 14, and effect development by developing rollers as developer carrying members having applied thereto a voltage variable by the signal of a controller.

The transferring belt 8 as the transferring member is rotatively driven in the direction of the at the same peripheral speed as that of the photosensitive drums 11 to 14. The transferring belt 8 is a single-layer resin belt of PVDF having a thickness of 100 μm and having its resistance adjusted to $1\times10^{11}$ Ω·cm, and is designed such that the meandering or biasing of the belt is regulated by ribs adhesively secured to the opposite edges of the back of the belt.

Also, as transferring members, use is made of transferring rollers to which a high voltage can be applied and of which the volume resistivity has been adjusted to $1\times10^5$ Ω·cm, and these transferring rollers are brought into contact with the nip portions of the photosensitive drums 11 to 14 from the back of the transferring belt.

Paper as a recording material fed from a paper cassette passes between registration rollers, and thereafter contacts with the transferring belt 8 through a transfer entrance guide.

In the present embodiment, the printer is of a construction in which cartridges are arranged in tandem so that in order to minimize the grounded area, and interchange the cartridges and deal with jam, the desired purposes can be achieved by the opening and closing of only a front door, and the main body is divided between the transferring belt and the cartridges.

From the above-described construction, the paper is conveyed upwardly against gravity and therefore, it is necessary that the paper be sufficiently adsorbed to the transferring belt.

An adsorbing roller 7 having a bias applied thereto is provided near the point of contact between the paper and the transferring belt 8, and during image formation, a voltage of +1 kV is applied thereto to give charges to the paper, thereby creating an adsorbing and conveying force.

The adsorbing roller 7 comprises a mandrel having a diameter of 6 mm and solid rubber molded thereon, and is of such a construction that a high voltage bias for adsorption can be applied to the mandrel.

The adsorbing roller 7 is a solid rubber roller having a diameter of 12 mm and formed of EPDM rubber and carbon black dispersed therein for resistance adjustment, and as regards the resistance value thereof, the resistance value when metal foil having a width of 1 cm is twined around the roller and a voltage of 500 V is applied to between it and the mandrel is adjusted to $1\times10^5$ Ω.

In the present embodiment, there is no cleaner exclusively for the transferring belt 8 and thus, jam toners and various patches formed on the belt pass through the nip between the adsorbing roller 7 and the transferring belt 8.

Therefore, during such a sequence, a bias of the opposite polarity (in the present embodiment, minus polarity) to the toners is applied to the absorbing roller 7, thereby preventing the toner stain of the back of the next print image. In the present embodiment, a voltage value of −300 V is adopted as the bias for preventing the adherence of the toners.

The paper fed from a paper feeding cassette, not shown, and having passed the transfer entrance guide and the adsorbing roller 7 and having obtained an adsorbing force relative to the transferring belt 8 enters the transferring station of the first color. The transferring portion has transferred thereto the toner image from the photosensitive drum 11 of the first color by the transferring roller 51 provided on the back of the transferring belt 8. A DC bias of +2 kV is applied from a high voltage source to the transferring roller 51.

Thereafter, each time the paper passes through each color station, a toner image of each different color is transferred from each of the photosensitive drums 11 to 14 to the paper, whereby a full color image is formed.

In the present embodiment, in order to absorb the influence given from the transferring charges imparted to the paper in each station to the transfer contrast, the transferring bias is increased by 300 V in each station, and for the fourth color, the transferring bias is set to 2.9 kV to thereby prevent bad transfer.

The paper to which all color images have been transferred and which has been separated from the rear end of the transferring belt 8 by curvature is then fixed by a heat roller fixing device 9, and is discharged out of the apparatus, and thus there is obtained a final print.

The cleaning sequence for the transferring belt will now be described.

In the in-line printer of the transferring belt type, toner images are formed always on the paper during image formation and therefore, the transferring belt is not stained by the toners.

However, when image formation has been done although no paper is conveyed due to paper feed jam, or when the size of designated paper does not match with the size of the image, the image is intactly written on the transferring belt.

Also, in order that the main body may effect density correction and color registration correction, generally images called a density patch and a registration patch are formed on the transferring belt, and these patches are read by an optical sensor opposed to the transferring belt and engine correction is effected, but if the cleaning of these is not effected, the toner stain of the back of the next image will be caused.

In the present embodiment, the cleaning of the transferring belt is effected by the electrostatic collection onto the photosensitive drums. When the toners on the transferring belt are to be collected, a discretely provided cleaning sequence is started. The cleaning sequence may effectively be effected after the occurrence of jam, after the detection of density, or after the detection of registration, but it is also possible to effect the sequence during the post-rotation after each print.

In the cleaning sequence, the adsorbing roller is spaced apart from the transferring belt, and a plus bias is applied to the transferring rollers in the first and third image forming stations, and a minus bias is applied to the transferring rollers in the second and fourth image forming stations, and the transferring belt is rotated by one round to thereby collect the toners of the plus and minus polarities.

In the present embodiment, during the cleaning sequence, the photosensitive drums are deelectrified to 0 V, and a bias of +1.5 kV and a bias of −1.5 kV are applied to the plus side and the minus side, respectively, to thereby effect toner collection.

By adopting the construction as described above, in the in-line electrophotographic apparatus of the transferring belt type, it becomes possible to accomplish good image formation without providing a cleaner exclusively for the transferring belt.

However, when the contact developing method as used in the present embodiment is adopted, there arises the problem of the fog during the starting of the developing devices.

Generally a contact developing apparatus is designed to be normally in contact with the photosensitive drum. When the polarity of the toner is minus, the surface potential of the photosensitive drum is controlled to minus potential stronger than that of a developer carrying member (hereinafter referred to as the developing roller) during image formation, whereby it is possible to forcibly create a state in which the toner is not used for development.

However, when the developing device is actuated at the start of printing, the charging process cannot be effected on the area between the primary charging device on the photosensitive body and the developing apparatus and therefore, there arises the problem that an area corresponding thereto is developed.

Also, after the developing device is left as it is for a long period after it has been finally used, the triboelectricity of the once charged toner on the developing roller is reduced and the fog at the start becomes very great.

In the construction of the present embodiment, the fog at the start not including the time after the long-period suspension of operation was 20 mg, and the fog at the start after the developing device has been left as it is for a long period was about 50 mg.

From the fact that the amount of toner used for the 4% printing of A4 generally defined as the standard original is about 20 mg, it will be seen that the fog at these starts is an amount which cannot be neglected.

Particularly, in an apparatus which is an in-line apparatus like the present embodiment and in which toners on the transferring belt are returned to the photosensitive drums and cleaning is effected, when these toners used for development shift to the transferring belt and this belt is cleaned, there arises the problem that the waste toner container in the first image forming station wherein the amount of collection is necessarily increased will immediately become full.

Also, when these toners used for development shift to the transferring belt, the toner stain of the back of the next print will be caused unless the transferring belt is cleaned, and when conversely, cleaning has been effected, it is necessary to start the cleaning sequence before a shift is made in the actual printing after the apparatus has been started and therefore, there has also arisen the contrary problem that the first print time is extended and usability is reduced.

In order to solve the these problems, in the present embodiment, the apparatus of the transferring belt type having no exclusive cleaning means is characterized that the developer carrying member is movable away from and toward the photosensitive drum, and in a situation such as during the starting of the developing apparatus wherein fog toner is produced, the position of the developer carrying member is changed to a second position spaced apart from the photosensitive drum by position changing control means.

Figure 1:
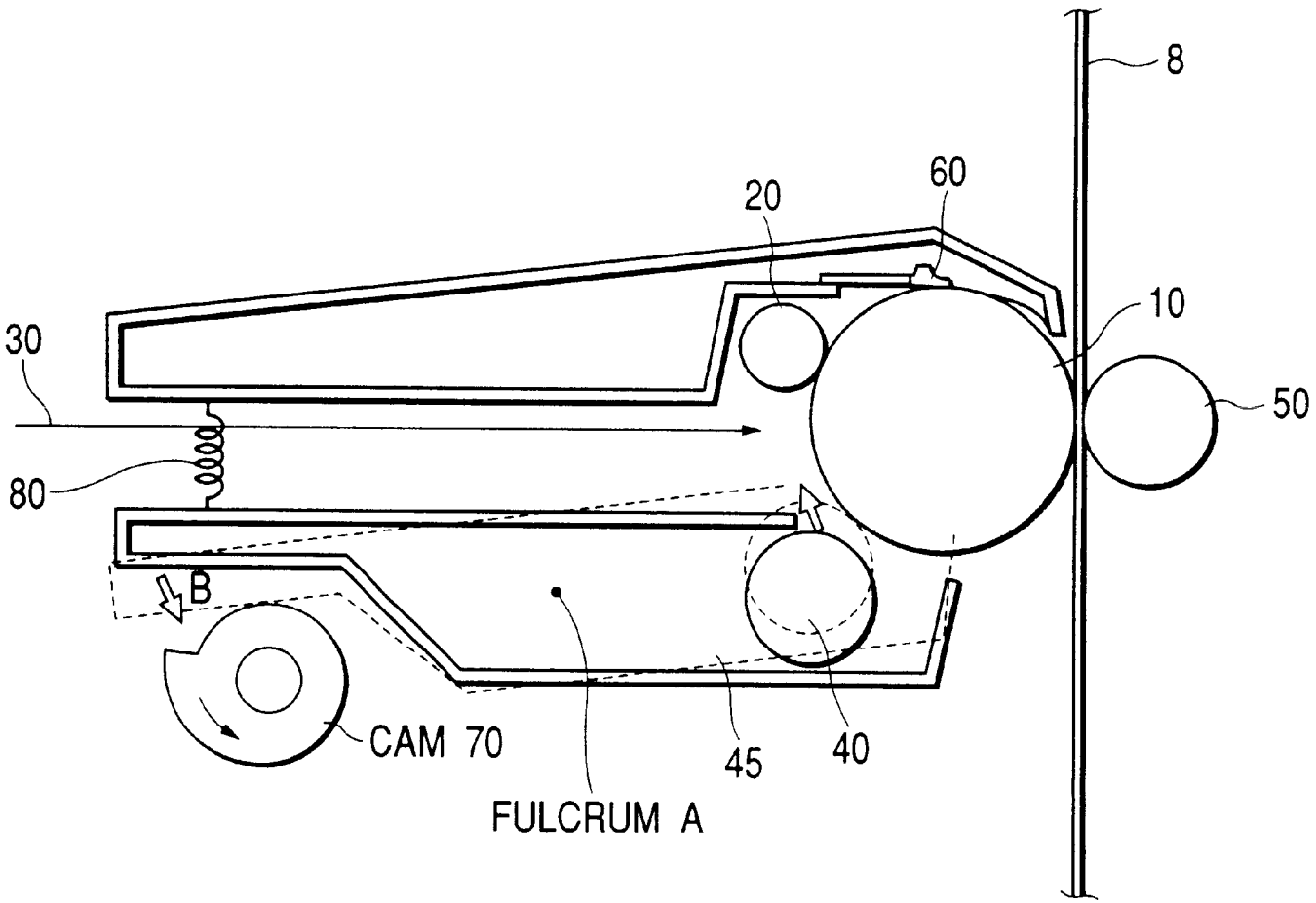
FIG. 1 schematically shows the construction of an image forming apparatus according to Embodiment 1 of the present invention.

A specific example of the movement away from and toward the photosensitive drum will now be shown. FIG. 1 is a schematic construction view representing the relation between the developing apparatus and the photosensitive drum. As shown in FIG. 1, the inner part side of the developing device 45 is pushed up about a fulcrum A by a cam 70, whereby the developing roller 40 as the developer carrying member is movable away from and toward the photosensitive drum 10. The reference numeral 80 designates a spring for biasing the developing apparatus in the direction of arrow B.

The application of the bias and the transmission of drive to the developing roller 40 are always possible irrespective of the movement of the developing device 45 away from and toward the photosensitive drum.

In order to prevent the fog at the starting of the developing device which offers a problem in the present embodiment, the developing device in its default maintains a spaced-apart position (a second position). When the apparatus is started by a printing command, the apparatus executes the sequence in the order of the starting of the rotation of the developing roller, the application of the developing bias and the contact with the photosensitive drum (a first position) by a command from a CPU (position changing control means).

At this time, the photosensitive drum, on the basis of the command from the CPU, assumes the sequence of the starting of the rotation of the photosensitive drum and the application of the charging bias to the charging means, but the relation between the developing roller and the photosensitive drum is set so that the surface of the photosensitive drum subjected to the primary charging process may be opposed to the contact position (first position) during the contact of the developing roller.

Also, during the spacing apart, conversely to this, in accordance with the sequence of the spacing apart of the developing roller, bias off and the stoppage of the developing roller, the operation is terminated, whereby printing can be effected smoothly without any excess toner adhering to the photosensitive drum when the developing apparatus is started and stopped.

As described above, in the present embodiment, the cleaning member for the transferring belt is not provided, but the adsorbing roller is spaced apart and the toners on the transferring belt are collected by the photosensitive drums of the image forming units, whereby it becomes possible to construct a compact electrophotographic apparatus which is high in reliability and excellent in usability.

Further, by adopting such a construction that at the starting of the developing apparatus, the developing roller is spaced apart from the photosensitive drum, it becomes possible to prevent the fog at the starting, and such problem as the puncture of the waste toner container for the photosensitive drum attributable thereto and the toner stain of the back of the next print by the toner stain of the transferring belt can be eliminated and thus, a good output can be obtained.

[Embodiment 2]

In Embodiment 2, an image forming apparatus of a construction in which as in Embodiment 1, the cleaning member for the transferring belt is not provided but the toners are collected into the image forming units is characterized in that in a construction wherein as the characteristic of the surface of the transferring belt which is contacted by the paper, an image patch or the like formed on the transferring belt is optically detected by detecting means and the condition of the main body is determined, the developing device is spaced apart from the photosensitive drum by the position changing control means when the optical information of the surface of the transferring belt which provides the reference of the detection is detected.

While in the present embodiment, description will be made with density detection taken as an example of the optical detection, it is also possible to apply a similar technique to registration detection, etc., and the following description does not restrict the gist of the present invention.

Description will hereinafter be made of density detecting means used in the present embodiment, and a sensor used for detection.

Figure 3:
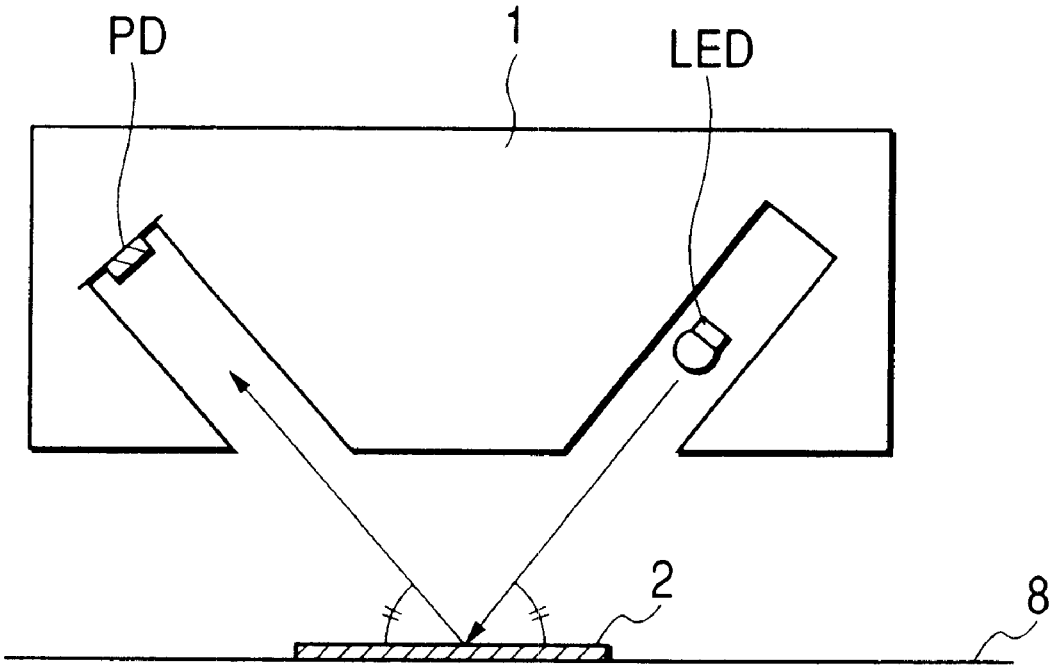
FIG. 3 schematically shows the construction of an optical sensor according to Embodiment 2 of the present invention.

As shown in FIG. 3, an optical sensor 1 as detecting means used for optical detection such as density detection uses as irradiating light such an LED of 880 nm that the absorption of each color of Y, M, C and K used is substantially constant, and the quantity of irradiating light is kept constant with feedback effected by a photodiode (PD) in a unit.

The optical sensor 1 is comprised of a light emitting system (LED) for irradiating a patch, and a light receiving system (PD) on which the patch is imaged with an optical spot diameter 0.8 mm on the transferring belt 8 by a lens, a pinhole (aperture) and a photodiode.

Design is made such that the irradiating light is imaged on the transferring belt 8 by the lens, and the quantity of regularly reflected light of the toner patch 2 passing through this portion is detected by the light receiving element.

Regularly reflected light, as compared with irregularly reflected light, can ensure a great quantity of received light to be secured and therefore the dynamic range of detection is wide, and can effect the detection of a black toner patch even on a black belt.

Detection is effected by forming a halftone toner patch of 12×12 mm on the transferring belt 8 for each station by the patch forming operation, and reading it by the afore-described optical sensor 1.

The quantity of light reflected by the halftone toner patch is changed by the reflected light from the surface of the transferring belt being hidden by the toner and therefore, the value thereof is determined by the amount of toner.

On the other hand, when the surface property of the transferring belt is changed by endurance deterioration or the like and the surface reflectance thereof is changed, a similar change in the quantity of light is brought about, and this becomes the factor of wrong detection.

Also, the quantity of reflected light from the surface of the transferring belt on which no toner is present is changed by the mounting accuracy or the like of the sensor and therefore, it is difficult to know the density of the toner with the absolute value of the signal, but by dividing the output signal when the toner is present by the output signal from the surface of the transferring belt when the toner is absent and using a value normalized thereby, it becomes possible to detect the density of the toner accurately irrespective of these disturbance factors.

To effect such normalization, it is necessary to measure the reflectance (ground) of the surface of the transferring belt in advance.

However, in the apparatus of the type having no cleaning means for the transferring belt as shown in Embodiment 1, if the fog toner or the like from the developing device is present when the measurement of the ground is effected, it will become a factor for causing wrong detection.

That is, although the user has originally intended to measure the reflectance of the belt itself, there is the possibility of such a situation occurring due to the presence of the fog toner which should not be detected.

In order to prevent such a problem, in the present embodiment, during the measurement of the ground, the developing apparatus and the photosensitive drum are spaced apart from each other in advance, whereby the unnecessary fog is not produced and always the reflectance of the surface of the transferring belt becomes capable of being measured accurately.

A specific example will be shown below.

When a density detection command is sent from the CPU, the main body starts the rotation of the photosensitive drums 11 to 14 and the transferring belt 8 in a default state (second position) wherein the developing devices 41 to 44 are spaced apart from the photosensitive drums 11 to 14, and renders the optical sensor 1 active. In this state, the transfer belt 8 is rotated by one round, and the ground reflectance at each location on the transferring belt 8 in the direction of movement thereof is measured and is stored in a memory.

Thereafter, in all the image forming stations in succession or at a time, the rotation of the developing rollers, the application of the bias and the contact of the developing rollers with the photosensitive drums (first position) are effected, and toner patches of the respective colors are formed on the photosensitive drums 11 to 14, and are transferred to the transferring belt 8, and values detected with respect to the respective patches by the optical sensor 1 are likewise stored in a memory.

After the termination of the detection, a value D1 corresponding to the detected value of the reflectance of the toner patch of each color and a value D0 corresponding to the ground reflectance corresponding to the position on the transferring belt on which the patch is formed are read out from the respective memories, and a value obtained by the normalization of D1/D0 is used as corrected detection data.

The main body increases or decreases the developing bias or adjusts image data as required so that this detection data may coincide with reference data given in advance, and becomes capable of optimizing a process parameter so that the same color can always be reproduced.

As described above, in the present embodiment, when measuring the optical information of the surface of the transferring belt which is the object for effect normalization in the means for optically detecting the toner image formed on the transferring belt, such as density detecting means, it becomes possible to space the developing apparatuses apart from the photosensitive drums by the position changing control means to thereby reduce the measurement error, and in whatever situation, the same color balance can always be realized.

While the embodiments of the present embodiment have been described above, the present invention is not restricted to these embodiments, but all modifications are possible within the technical idea of the invention.

What is claimed is:

1. An image forming apparatus comprising:

an image bearing member;

a charger for charging said image bearing member;

image forming means for selectively erasing a charge on said image bearing member to thereby form an electrostatic image;

a developing device for developing the electrostatic image with a developer, said developing device including a developing roll for carrying the developer, said developing roll being capable of having a developing bias applied thereto; and contacting and spacing means for contacting and spacing said developing roll with respect to said image bearing member, wherein, after the developing bias is applied to said developing roll, said contacting and spacing means effects a contacting operation for contacting said developing roll with an area of said image bearing member, which is charged by said charger, at a start of image formation.

2. An image forming apparatus according to claim 1, wherein said developing device is turned off after said contacting said spacing means effects a spacing operation for spacing said developing roll with respect to said image bearing member at an end of the image formation.

3. An image forming apparatus according to claim 1, wherein said image forming means is capable of forming a test image on said image bearing member, and said contacting and spacing means contacts said developing roll with said image bearing member in conformity with a formation timing of the test image.

4. An image forming apparatus according to claim 1, wherein said developing device is pivotally movable about a pivot shaft, and said contacting and spacing means pivotally moves said developing device to thereby contact and space said developing roll with respect to said image bearing member.

5. An image forming apparatus according to claim 1, further comprising a transferring rotary member for transferring a developed image on said image bearing member to a transferring material, wherein a voltage of a polarity opposite to a polarity during the transfer is applied to said transferring rotary member to thereby shift a developer on said transferring rotary member to said image bearing member.

6. An image forming apparatus according to claim 1, wherein at least said image bearing member and said developing device are constructed as a process cartridge in an integral unit.

7. An image forming apparatus according to claim 1, wherein said developing roll reversal-develops the electrostatic image.

8. An image forming apparatus comprising:

an image bearing member;

a charger for charging said image bearing member;

image forming means for selectively erasing a charge on said image bearing member to thereby form an electrostatic image;

a developing device for developing the electrostatic image with a developer, said developing device including a developing roll for carrying the developer, said developing roll being capable of having a developing bias applied thereto; and contacting and spacing means for contacting and spacing said developing roll with respect to said image bearing member;

wherein, after the developing bias is applied to said developing roll, said contacting and spacing means effects a contacting operation for contacting said developing roll with an area of said image bearing member, which is charged by said charger, at a start of image formation, wherein said image forming means is capable of forming a test image on said image bearing member, and said contacting and spacing means contacts said developing roll with said image bearing member in conformity with a formation timing of the test image.

* * * * *

UNITED STATES PATENT AND TRADEMARK OFFICE

CERTIFICATE OF CORRECTION

PATENT NO. : 6,466,755 B2
DATED : October 15, 2002
INVENTOR(S) : Hideyuki Yano et al.

It is certified that error appears in the above-identified patent and that said Letters Patent is hereby corrected as shown below:

Column 3,
Line 50, “u s ed” should read -- used --.

Column 5,
Line 66, “of the” should read -- of the arrows --.

Column 11,
Line 51, “said” should read -- and --.

Signed and Sealed this

Eleventh Day of March, 2003

JAMES E. ROGAN
*Director of the United States Patent and Trademark Office*